US010181290B2

(12) United States Patent
Jang et al.

(10) Patent No.: US 10,181,290 B2
(45) Date of Patent: Jan. 15, 2019

(54) DISPLAY DEVICE AND METHOD OF DRIVING THE SAME

(71) Applicant: LG Display Co., Ltd., Seoul (KR)

(72) Inventors: Hoon Jang, Goyang-si (KR); Wonyong Jang, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/991,837

(22) Filed: May 29, 2018

(65) Prior Publication Data

US 2018/0277041 A1 Sep. 27, 2018

Related U.S. Application Data

(62) Division of application No. 14/975,629, filed on Dec. 18, 2015, now Pat. No. 10,008,152.

(30) Foreign Application Priority Data

Dec. 24, 2015 (KR) ..... 10-2014-0188924

(51) Int. Cl.

| | |
|---|---|
| ***G09G 5/00*** | (2006.01) |
| ***G09G 3/3258*** | (2016.01) |
| ***G09G 3/20*** | (2006.01) |
| ***G09G 3/36*** | (2006.01) |

(52) U.S. Cl.

CPC ..... *G09G 3/3258* (2013.01); *G09G 3/20* (2013.01); *G09G 3/3648* (2013.01); *G09G 3/3696* (2013.01); *G09G 2310/0267* (2013.01); *G09G 2310/063* (2013.01); *G09G 2310/08* (2013.01); *G09G 2320/0257* (2013.01); *G09G 2330/02* (2013.01); *G09G 2330/027* (2013.01)

(58) Field of Classification Search

CPC ..... G09G 2330/00; G09G 2330/02; G09G 2330/021; G09G 3/3674; G09G 1/005

USPC ..... 345/211

See application file for complete search history.

(56) References Cited

U.S. PATENT DOCUMENTS

2002/0041279 A1* 4/2002 Chou ..... G09G 3/3611 345/211

2003/0184538 A1* 10/2003 Yamato ..... G09G 3/3696 345/211

(Continued)

OTHER PUBLICATIONS

United States Office Action, U.S. Appl. No. 14/975,629, dated Nov. 2, 2017, 11 pages.

*Primary Examiner* — Roy P Rabindranath

(74) *Attorney, Agent, or Firm* — Fenwick & West LLP

(57) ABSTRACT

Embodiments relate to a display device and a method of operating the display device. The display device includes a power supply circuit configured to generate a gate voltage at an output terminal of the power supply circuit based on an input voltage to supply the gate signal to the pixels of the panel. The display device generates a switching pulse signal for a predetermined time period after the input voltage dropping below the predetermined threshold voltage. The display device generates the gate voltage at a first voltage level responsive to the switching pulse signal, the gate voltage at the first voltage level higher than the gate voltage at a second voltage level absent the switching pulse signal. Charges stored in pixels are discharged by applying the gate voltage to the pixels through gate lines, responsive to the input voltage dropping below the predetermined threshold voltage.

7 Claims, 12 Drawing Sheets

(56) References Cited

U.S. PATENT DOCUMENTS

| | | | | |
|---|---|---|---|---|
| 2008/0143702 | A1* | 6/2008 | Park | G09G 3/3648 345/211 |
| 2008/0225034 | A1 | 9/2008 | Pi et al. | |
| 2008/0238852 | A1* | 10/2008 | Tsai | G09G 3/20 345/98 |
| 2010/0277462 | A1 | 11/2010 | Ting et al. | |
| 2013/0147697 | A1 | 6/2013 | Sung et al. | |
| 2014/0092144 | A1 | 4/2014 | Kim et al. | |

* cited by examiner (a)

(b)

DISPLAY DEVICE AND METHOD OF DRIVING THE SAME

CROSS-REFERENCE TO RELATED APPLICATION

This application is a divisional application of U.S. patent application Ser. No. 14/975,629 filed on Dec. 18, 2015, which claims the benefit of Korean Patent Application No. 10-2014-0188924, filed on Dec. 24, 2014, all of which are incorporated herein by reference for all purposes as if fully set forth herein.

BACKGROUND

Field

The present invention relates to a display device and a method of driving the same.

Related Art

As information-oriented technology develops, a market of a display device, which is a connection medium between a user and information has been increased. Accordingly, use of a display device such as an Organic Light Emitting Display (OLED), a Liquid Crystal Display (LCD), and a Plasma Display Panel (PDP) has been increased.

The OLED and the LCD of the foregoing display devices include a display panel including a plurality of subpixels disposed in a matrix form, a driver that drives the display panel, and a timing controller that controls the driver. The driver includes a scan driver that supplies a scan signal (or a gate signal) to the display panel and a data driver that supplies a data signal to the display panel.

In order to block a voltage output from a power supply unit and to discharge electric charges charged in a display panel when power is turned off, the foregoing display device supplies a gate signal corresponding to a gate high voltage to entire gate lines.

The display device may be implemented to trigger a gate signal to a gate high voltage in a state in which a power supply unit stops operation due to power off. Accordingly, a gate high voltage may be output in a level lower than that at a normal operation. However, when a level of a gate high voltage is too low, a discharging operation may be recognized by an eye of a person or image quality deterioration (screen shake) may occur.

SUMMARY

In one or more embodiments, a display device comprising a panel including pixels coupled to gate lines, a power supply circuit, and a panel discharge circuit is disclosed. In one or more embodiments, the power supply circuit is configured to receive an input voltage, generate a switching pulse signal responsive to the input voltage being above a predetermined threshold voltage, generate the switching pulse signal for a predetermined time period after the input voltage dropping below the predetermined threshold voltage from above the predetermined threshold voltage, and generate a gate voltage at a first voltage level responsive to the switching pulse signal, the gate voltage at the first voltage level higher than the gate voltage at a second voltage level absent the switching pulse signal. The panel discharge circuit is configured to discharge charges stored in the pixels by applying the gate voltage to the pixels through the gate lines, responsive to detecting the input voltage dropping below the predetermined threshold voltage from above the predetermined threshold voltage.

In one or more embodiments, the panel discharge circuit includes a signal output unit configured to generate a discharge signal responsive to the input voltage dropping below the predetermined threshold voltage, and a gate driver configured to discharge charges stored in the pixels by applying the gate voltage to the pixels through the gate line responsive to receiving the discharge signal, and apply a gate signal to the pixels to display image, responsive to not receiving the discharge signal.

BRIEF DESCRIPTION OF THE DRAWINGS

The accompany drawings, which are included to provide a further understanding of certain embodiments and are incorporated in and constitute a part of this specification illustrate embodiments and together with the description serve to explain the principles of various embodiments.

DETAILED DESCRIPTION

Reference will now be made in various embodiments examples of which are illustrated in the accompanying drawings.

Hereinafter, exemplary embodiments will be described in detail with reference to the accompanying drawings.

A display device of various embodiments described herein may be implemented with a display panel such as a liquid crystal display panel, an organic light emitting display panel, an electrophoresis display panel, and a plasma display panel, but the display device is not limited thereto. However, in the following description, for convenience of description, a display device based on a liquid crystal display panel will be described as an example.

First Exemplary Embodiment

Figure 1:
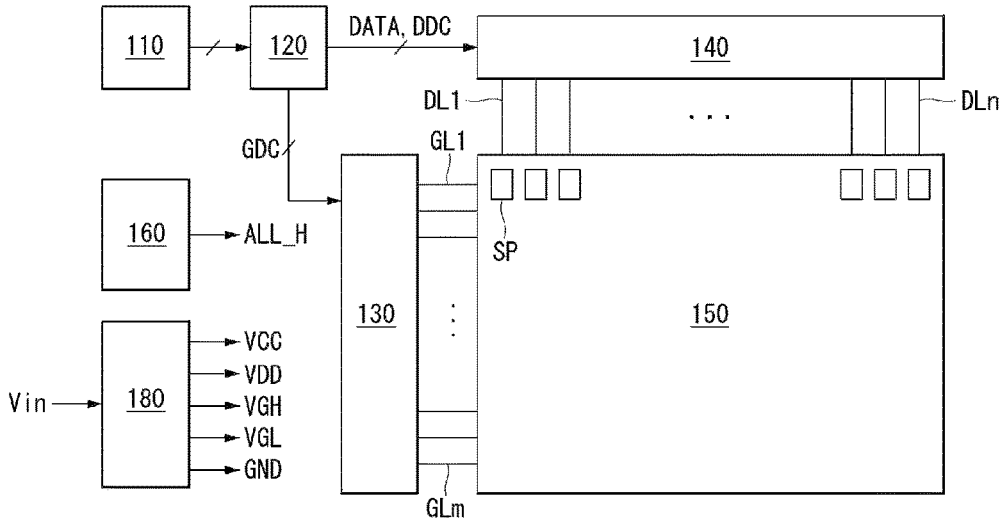
FIG. 1 is a block diagram illustrating a display device.
Figure 2:
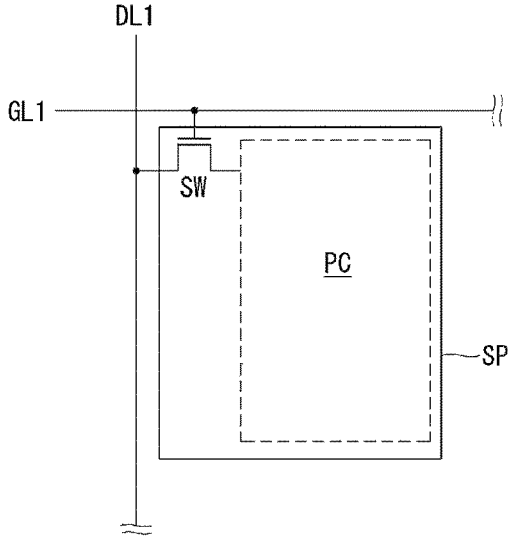
FIG. 2 is a diagram illustrating a configuration of a subpixel of FIG. 1.

FIG. 1 is a block diagram illustrating a display device, and FIG. 2 is a diagram illustrating a configuration of a subpixel of FIG. 1.

As shown in FIG. 1, the display device includes an image supply unit 110, a timing controller 120, a gate driver 130, a data driver 140, a display panel 150, a signal output unit 160, and a power supply unit 180.

The image supply unit 110 performs an image processing of a data signal and outputs the data signal together with a vertical synchronization signal, a horizontal synchronization signal, a data enable signal, and a clock signal. The image supply unit 110 supplies a vertical synchronization signal, a horizontal synchronization signal, a data enable signal, a clock signal, and a data signal to the timing controller 120 through a Low Voltage Differential Signaling (LVDS) interface or a Transition Minimized Differential Signaling (TMDS) interface.

The timing controller 120 receives the supply of a data signal DATA from the image supply unit 110 and outputs a gate timing control signal GDC for controlling operation timing of the gate driver 130 and a data timing control signal DDC for controlling operation timing of the data driver 140.

The timing controller 120 outputs a data signal DATA together with a gate timing control signal GDC and a data timing control signal DDC through a communication interface (e.g., EPI) and controls operation timing of the gate driver 130 and the data driver 140.

The gate driver 130 outputs a gate signal (or a scan signal) while shifting a level of a gate voltage in response to a gate timing control signal GDC supplied from the timing controller 120. The gate driver 130 includes a level shifter and a shift register.

The gate driver 130 supplies a gate signal to subpixels SP included in the display panel 150 through gate lines GL1-GLm. The gate driver 130 is formed in an Integrated Circuit (IC) form or is formed in a Gate In Panel method in the display panel 150. A portion formed in a Gate In Panel method in the gate driver 130 is a shift register.

The data driver 140 samples and latches a data signal DATA in response to a data timing control signal DDC supplied from the timing controller 120 and converts and outputs an analog signal to a digital signal to correspond to a gamma reference voltage.

The data driver 140 supplies a data signal DATA to subpixels SP included in the display panel 150 through data lines DL1-DLn. The data driver 140 is formed in an Integrated Circuit (IC) form.

The signal output unit 160 generates and outputs a gate all high signal ALL_H that changes entire gate signals supplied through entire gate lines GL1-GLm of the display panel 150 to a gate high voltage. The signal output unit 160 may monitor an input voltage Vin input to the power supply unit 180 or an output voltage VCC output from the power supply unit 180.

In one aspect, a panel discharge circuit including the signal output unit 160 and the gate driver 130 operate together to discharge charges stored in the panel 150, if the input voltage Vin drops below a threshold voltage. The signal output unit 160 generates a gate all high signal ALL_H responsive to the input voltage Vin dropping below a threshold voltage level, and supplies the gate all high signal ALL_H to the gate driver 130. The gate driver 130, responsive to receiving the gate all high signal ALL_H, discharges charges stored in the panel 150 or causes the panel 150 to discharge the charges stored in the panel 150.

When a level of an input or output voltage is dropped below a threshold, the signal output unit 160 may trigger a gate signal to a gate high voltage. However, this is an illustration, and the signal output unit 160 may be included in the power supply unit 180 or another circuit. The signal output unit 160 may generate and output a gate all high signal ALL_H based on a gate high voltage VGH output from the power supply unit 180.

The power supply unit 180 generates and outputs a power source such as a first power source voltage VDD, a second power source voltage VCC, a gate high voltage VGH, a gate low voltage VGL, and a low potential voltage GND based on an input voltage Vin. An output voltage output from the power supply unit 180 is divided and supplied to the timing controller 120, the gate driver 130, the data driver 140, and the display panel 150.

The display panel 150 displays an image to correspond to a gate signal supplied from the gate driver 130 and a data signal DATA supplied from the data driver 140. The display panel 150 includes subpixels SP that emit light themselves in order to display an image or that control light of the outside.

As shown in FIG. 2, one subpixel includes a switching thin film transistor SW connected to (or formed in a crossing region) a gate line GL1 and a data line DL1 and a pixel circuit PC that operates to correspond to a data signal DATA supplied through the switching thin film transistor SW. The subpixels SP are formed with a liquid crystal display panel including a liquid crystal element according to a configuration of a pixel circuit PC or an organic light emitting display panel including an organic light emitting element.

When the display panel 150 is formed with a liquid crystal display panel, the display panel 150 is implemented with a Twisted Nematic (TN) mode, a Vertical Alignment (VA) mode, an In Plane Switching (IPS) mode, a Fringe Field Switching (FFS) mode, or an Electrically Controlled Birefringence (ECB) mode. When the display panel 150 is formed with an organic light emitting display panel, the display panel 150 is implemented with a Top-Emission method, a Bottom-Emission method, or a Dual-Emission method.

At power off that blocks a voltage output from the power supply unit 180, in order to discharge electric charges charged at the display panel 150, the foregoing display device supplies a gate signal corresponding to a gate high voltage VGH to entire gate lines GL1-GLn.

A power supply unit may be implemented to trigger a gate signal to a gate high voltage in a state in which a power supply unit stops operation due to power off. Accordingly, a gate high voltage output from the power supply unit may be output to a level lower than that in a normal operation.

However, when a level of a gate high voltage is too low, a discharging operation of a panel may be recognized by an eye of a person or image quality deterioration (screen shake) may occur.

Figure 3:
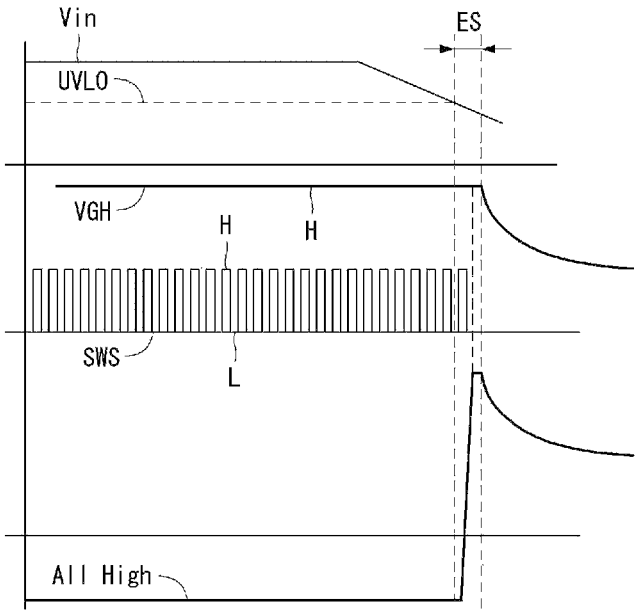
FIG. 3 is a waveform diagram illustrating a method of driving a device according to a first exemplary embodiment.
Figure 4:
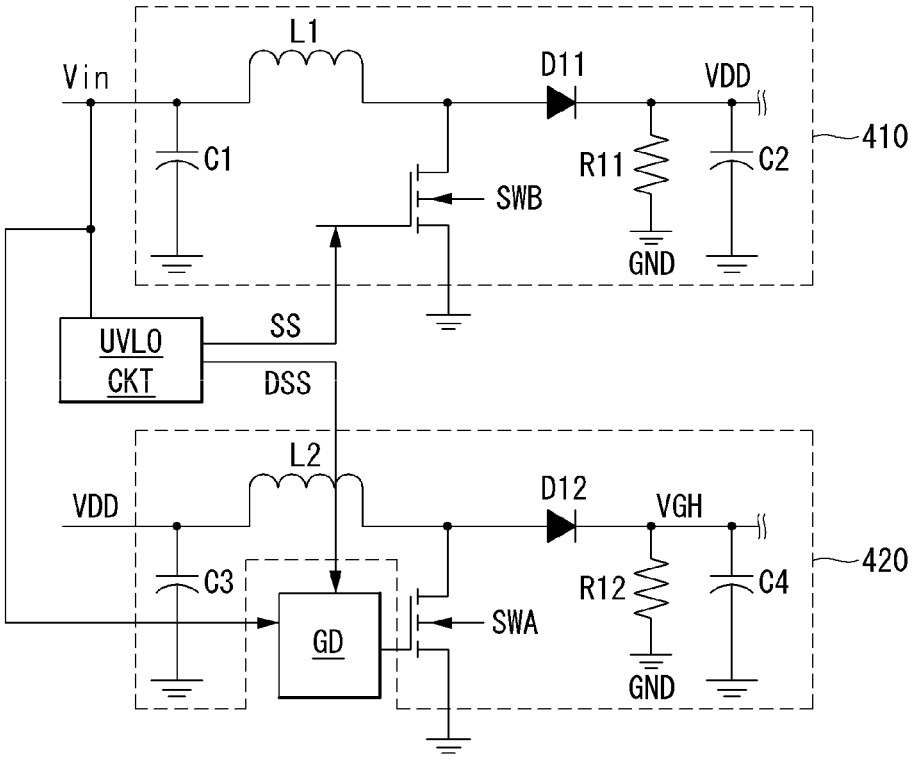
FIG. 4 is a diagram illustrating a circuit configuration of a portion of a power supply unit according to a first exemplary embodiment.
Figure 5:
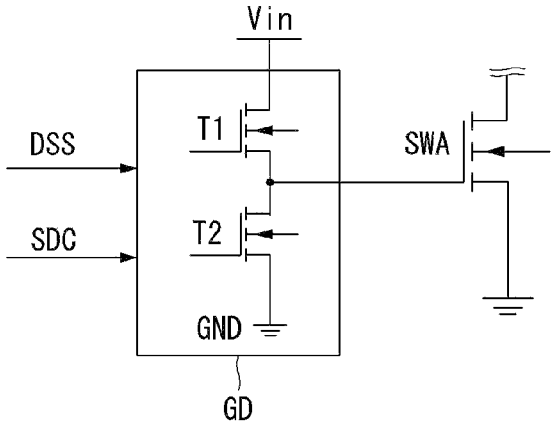
FIG. 5 is a diagram illustrating a circuit configuration of a gate voltage driver of FIG. 4.

FIG. 3 is a waveform diagram illustrating a method of driving a device according to a first exemplary embodiment, FIG. 4 is a diagram illustrating a circuit configuration of a portion of a power supply unit according to a first exemplary embodiment, and FIG. 5 is a diagram illustrating a circuit configuration of a gate voltage driver of FIG. 4.

As shown in FIGS. 3 and 4, in a display device according to a first exemplary embodiment, even after an input voltage Vin input to a power supply unit is dropped to a level of a Under Voltage Lock Out (hereinafter, UVLO) or less due to power off, a switching signal SWS for driving switching transistors SWA and SWB is not stopped but maintained (or delayed) for a predetermined time. In FIG. 3, All High means a signal that causes the gate driver 130 to apply gate pulses to the panel 150 through all of gate lines GL1 through GLm simultaneously. For example, the signal output unit 160 applies the All High signal to the gate driver 130 to perform discharge operation of the panel 150.

If a switching signal SWS for driving switching transistors SWA and SWB was stopped when an input voltage Vin was dropped to UVLO or less due to power off, a gate high voltage VGH with a voltage charged at the inside of a power supply unit can be formed in a state in which the power supply unit stops operation.

However, in a first exemplary embodiment, even if an input voltage Vin is dropped to UVLO or less due to power off, a switching signal SWS for driving a first switching transistor SWA is further maintained for a dummy switching period ES. Therefore, in a first exemplary embodiment, in a state in which a power supply unit maintains operation for a predetermined time, a voltage is generated and a gate high voltage VGH is formed based on the generated voltage.

Therefore, in a first exemplary embodiment, a gate all high signal (All High) is generated based on a high level of gate high voltage VGH that has occurred for a dummy switching period ES. Therefore, in a first exemplary embodiment, when power is turned off (after UVLO Lock), discharging of a panel may be stably performed.

Hereinafter, a description will be made based on a circuit configuration of FIGS. 4 and 5.

A power supply unit according to a first exemplary embodiment generates and outputs a first power source voltage VDD and a gate high voltage VGH based on an input voltage Vin. The power supply unit includes an UVLO circuit unit (UVLO CKT), a gate voltage driver (GD), and first and second switching transistors SWA and SWB. The power supply unit includes a first power source voltage generator 410 that generates and outputs a first power source voltage VDD and a gate high voltage generator 420 that generates and outputs a gate high voltage VGH.

In one aspect, the first power source voltage generator 410 includes a capacitor C1, an inductor L1, the second switching transistor SWB, a diode D11, a resistor R11, and another capacitor C2. The first power source voltage generator 410 receives the input voltage Vin and generates the first power source voltage VDD. The first power source voltage VDD corresponds to a driving voltage of the display panel 150.

In one example, the input voltage Vin is coupled to a first node of the capacitor C1 and a first node of the inductor L1. A second node of the capacitor C1 is coupled to ground. A second node of the inductor L1 is coupled to a first node of the second switching transistor SWB and a first node of the first diode D11. The second node of the second switching transistor SWB is coupled to ground, and a third node of the second switching transistor SWB is coupled to UVLO CKT. A second node of the first diode D11 is coupled to an output terminal of the first power source voltage generator 410 for supplying first power source voltage VDD. The output terminal of the first power source voltage generator 410 is also coupled to a first node of the resistor R11 and a first node of another capacitor C2. A second node of the resistor R11 and a second node of the capacitor C2 are coupled to ground.

In one aspect, the gate high voltage generator 420 (herein also referred to as "a second power source voltage generator 420") includes a capacitor C3, an inductor L2, the first switching transistor SWA, a diode D12, a resistor R12, and another capacitor C4. The gate high voltage generator 420 receives the first power source voltage VDD from the first power source voltage generator 410, and generates the gate high voltage VGH. The gate high voltage VGH is used to generate a gate signal (e.g., a high portion of the gate signal).

In one example, the output terminal of the first power source voltage generator 410 is coupled to a first node of the capacitor C3 and a first node of the inductor L2. A second node of the capacitor C3 is coupled to ground. A second node of the inductor L2 is coupled to a first node of the first switching transistor SWA and a first node of the second diode D12. The second node of the first switching transistor SWA is coupled to ground, and a third node of the first switching transistor SWA is coupled to GD. A second node of the second diode D12 is coupled to an output terminal of the gate high voltage generator 420 for supplying the gate high voltage VGH. The output terminal of the gate high voltage generator 420 is also coupled to a first node of the resistor R12 and a first node of another capacitor C4. A second node of the resistor R12 and a second node of the capacitor C4 are coupled to ground.

The UVLO CKT monitors an input voltage Vin, and when the input voltage Vin is changed to a level lower than an operation voltage for operation of the power supply unit, the UVLO CKT performs a function of stopping a switching operation in order to protect a circuit.

For example, when an input voltage Vin is changed (dropped) to a level lower than an operation voltage due to power off of the device, the UVLO CKT immediately stops a switching operation of a second switching transistor SWB. However, even if an input voltage Vin is dropped to a level lower than an operation voltage due to power off, the UVLO CKT maintains a switching operation of the first switching transistor SWA for a predetermined time (dummy switching period).

The GD outputs a switching signal SWS that controls the first switching transistor SWA to boost a first power source voltage VDD transferred from a first power source voltage generator to convert the first power source voltage VDD to a gate high voltage VGH.

The GD outputs a switching signal SWS that may maintain a switching operation of the first switching transistor SWA for a predetermined time (dummy switching period) to correspond to a switching delay signal DSS transferred from the UVLO CKT. When a switching delay signal DSS is transferred from the UVLO CKT, the GD may output a switching signal that generates a gate high voltage VGH using an input voltage Vin as a power source.

The first switching transistor SWA switches a first power source voltage VDD to correspond to a switching signal SWS output from the GD and generates and outputs a gate high voltage VGH. The first switching transistor SWA may generate and output a gate high voltage VGH for a predetermined time (dummy switching period) to correspond to a switching delay signal DSS transferred from the UVLO CKT.

The second switching transistor SWB switches an input voltage Vin to correspond to a signal output from an internal circuit and generates and outputs a first power source voltage VDD. The second switching transistor SWB stops a switching operation to correspond to a switching stop signal SS transferred from the UVLO CKT. When an input voltage Vin is changed to a level lower than that of an operation voltage for operation of the power supply unit, the switching stop signal SS is output from the UVLO CKT.

As shown in FIG. 5, the GD includes first and second transistors T1 and T2 that operate to correspond to a switching delay signal DSS and a switching duty control signal SDC, respectively. The switching duty control signal SDC determines a turn on duty of the driving switching transistor SWA, when the gate high voltage generator 420 (e.g., boost converter) is driven. In one implementation, the switching delay signal DSS and the switching duty control signal SDC are both generated by the UVLO CKT. In another implementation, the switching duty control signal SDC is generated by a timing control circuit (not shown) within the power supply unit 180 separate from the UVLO CKT.

The first and second transistors T1 and T2 are located between an input voltage line to which an input voltage Vin is supplied and a low potential voltage line to which a low potential voltage GND is supplied. A gate electrode of the first transistor T1 is connected to a switching delay signal line to which a switching delay signal DSS is supplied, a first electrode of the first transistor T1 is connected to an input voltage line, and a second electrode of the first transistor T1 is connected to a gate electrode of the first switching transistor SWA. A gate electrode of the second transistor T2 is connected to a switching duty control signal line to which a switching duty control signal SDC is supplied, a first electrode of the second transistor T2 is connected to a low potential voltage line, and a second electrode of the second transistor T2 is connected to a gate electrode of the first switching transistor SWA.

The first and second transistors T1 and T2 control the first switching transistor SWA to correspond to the switching delay signal DSS and the switching duty control signal SDC. A switching signal that controls a switching operation of the first switching transistor SWA varies a pulse width or a duty according to a turn on/turn off operation of the first and second transistors T1 and T2.

However, this is an illustration, and in order to prepare a case in which a power source of a GD is not enough only with an input voltage Vin, the power source of the GD may be formed as follows.

A gate voltage driver according to a second exemplary embodiment described hereinafter is different from the gate voltage driver of FIG. 4, the gate voltage driver is described in detail hereinafter, and portions related to other configurations are identical to or corresponding to those of the first exemplary embodiment and therefore a detailed description thereof is omitted.

Second Exemplary Embodiment

Figure 6A:
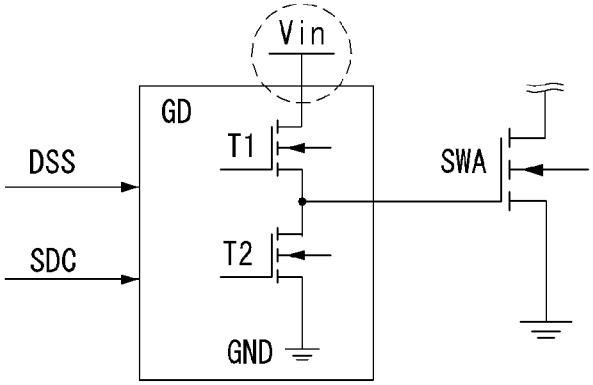
FIG. 6A is a diagram illustrating a circuit configuration of a gate voltage driver according to a second exemplary embodiment.

FIG. 6A is a diagram illustrating a circuit configuration of a gate voltage driver according to a second exemplary embodiment.

As shown in FIG. 6A a gate voltage driver (GD) includes first and second transistors T1 and T2 that operate to correspond to a switching duty control signal SDC and a switching delay signal DSS output from an UVLO CKT.

Figure 6B:
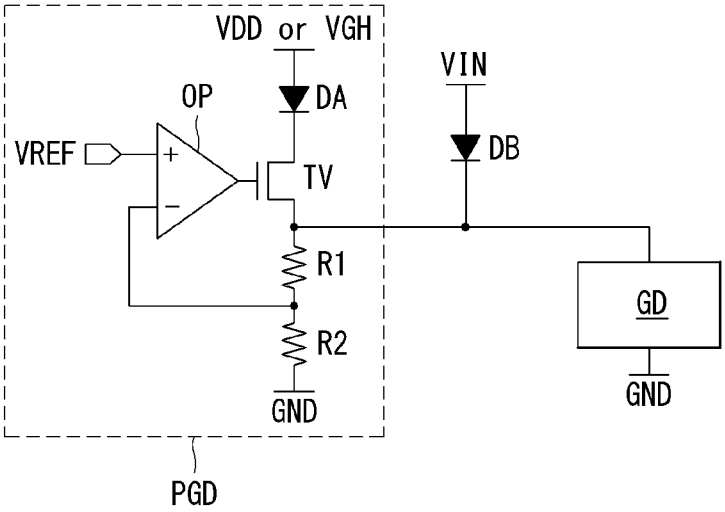
FIG. 6B is a diagram illustrating a circuit configuration of a gate voltage compensation unit coupled to gate voltage driver of FIG. 6A according to a second exemplary embodiment.

As shown in FIG. 6B, the GD is coupled to a gate voltage compensation unit (PGD) together with the foregoing circuit. The PGD is a circuit that compensates a voltage by preparing a case in which power of the GD is not enough with only an input voltage Vin.

The PGD receives the supply of a first power source voltage VDD or a gate high voltage VGH as power, and the GD supplies a voltage that can stably perform boost switching for a predetermined time to a power source terminal of the GD based on the first power source voltage VDD or the gate high voltage VGH.

The PGD includes a comparison circuit unit (e.g., OP amplifier circuit unit) (OP), a first diode DA, a voltage compensation transistor (TV), a first resistor (R1), and a second resistor (R2).

In the OP, a non-inverting terminal (+) is connected to a reference line to which a reference voltage VREF is supplied, an inverting terminal (−) is connected to a node between the R1 and the R2, and an output terminal is connected to the TV. The OP compares a preset reference voltage VREF and a voltage of an output terminal of the PGD thereof, and when a voltage to supply to a power source terminal of the GD is insufficient, the OP operates to output a first power source voltage VDD or a gate high voltage VGH.

A gate electrode of the TV is connected to the output of the OP, a first electrode of the TV is connected to one end of the first diode DA, and a second electrode of the TV is connected to one end of the R1. The second electrode of the TV becomes an output terminal of PGD that outputs a voltage output from the PGD and is connected to a power source terminal of the GD.

An anode electrode of the first diode DA is connected to a voltage line that supplies a first power source voltage VDD or a gate high voltage VGH, and a cathode electrode of the first diode DA is connected to a first electrode of the TV. One end of a first resistor R1 is connected to a second electrode of the TV and the other end of the first resistor R1 is connected to one end of a second resistor R2. One end of the second resistor R2 is connected to the other end of the first resistor R1 and an inverting terminal (−) of the OP, and the other end of the second resistor R2 is connected to a low potential voltage line to which a low potential voltage GND is supplied.

An anode electrode of the second diode DB is connected to an input voltage line to which an input voltage Vin is supplied, and a cathode electrode of the second diode DB is connected to an output terminal of the PGD. The second diode DB prevents collision between an input voltage Vin and a first power source voltage VDD or a gate high voltage VGH output through an output terminal of the PGD. However, the second diode DA may be replaced with another passive element or circuit.

In a second exemplary embodiment, generation and output of a gate high voltage VGH based on an input voltage Vin or a first power source voltage VDD for a dummy switching period has been described as an example. However, this is an exemplary embodiment and a power supply unit detects an input voltage Vin, a first power source voltage VDD, or another high potential voltage through a voltage detection unit for a dummy switching period and determines a level thereof and may temporarily generate and output a gate high voltage VGH using a voltage of a highest level among them.

This may be used when a source voltage to convert to a gate high voltage VGH is not enough. In this case, at the inside of the power supply unit, a voltage detection unit that can detect and compare an input voltage or an output voltage is further included.

Third Exemplary Embodiment

Figure 7:
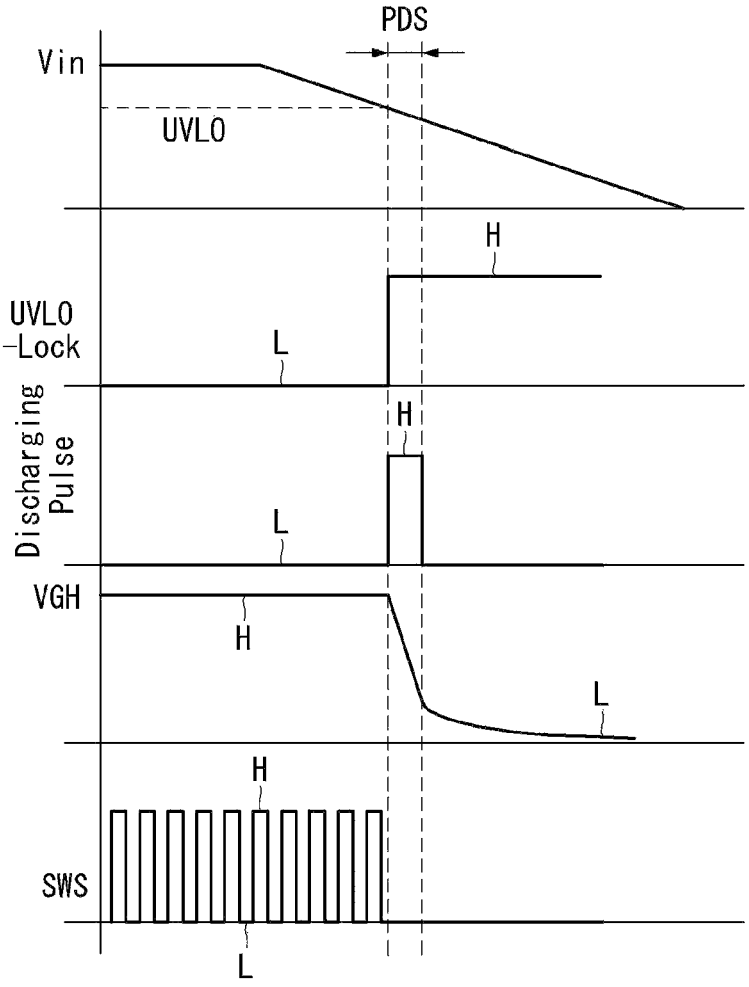
FIG. 7 is a waveform diagram illustrating a method of driving a device according to a third exemplary embodiment.
Figure 8:
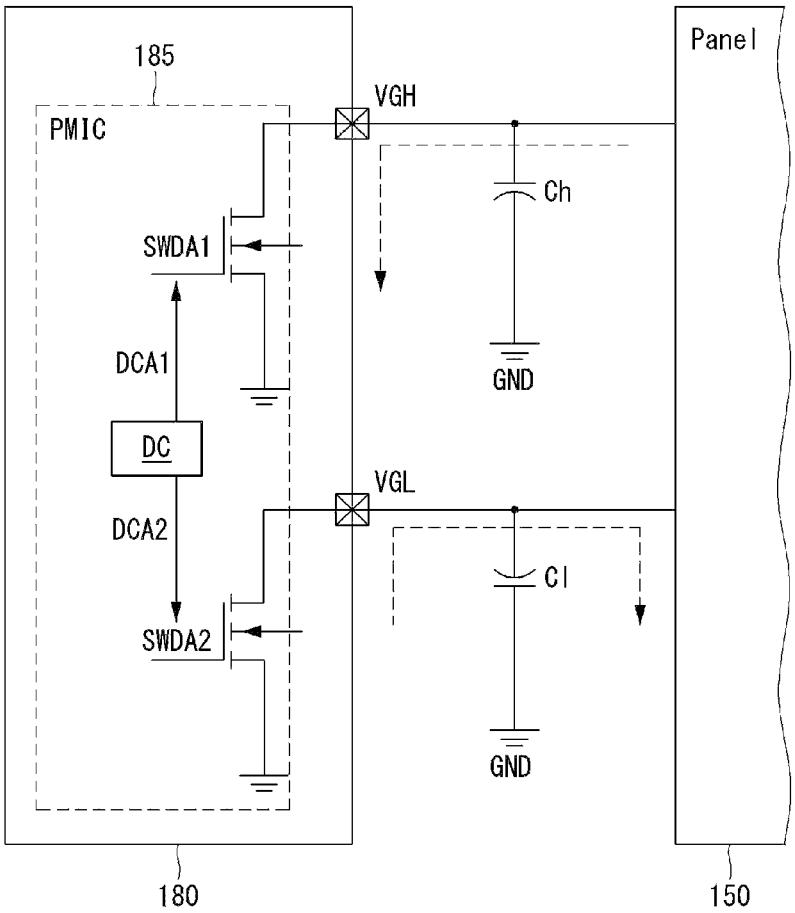
FIG. 8 is a diagram illustrating a circuit configuration of a portion of a power supply unit according to a third exemplary embodiment.
Figure 9:
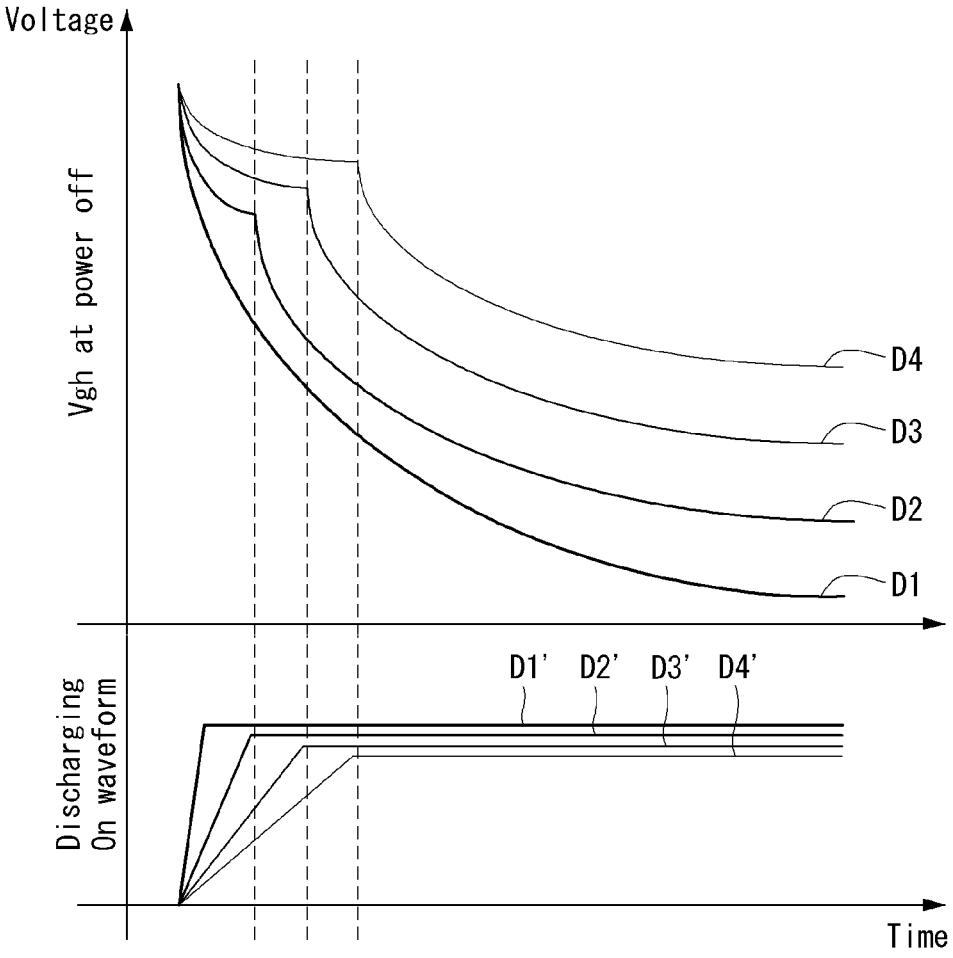
FIGS. 9 and 10 are graphs illustrating an effect according to a third exemplary embodiment.
Figure 10:
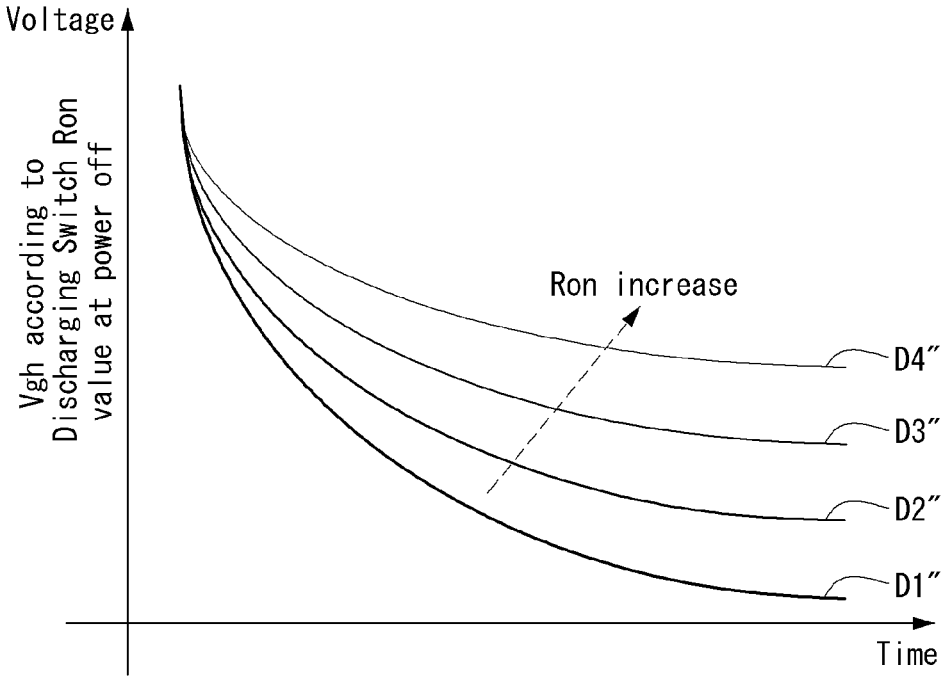

FIG. 7 is a waveform diagram illustrating a method of driving a device according to a third exemplary embodiment, FIG. 8 is a diagram illustrating a circuit configuration of a portion of a power supply unit according to a third exemplary embodiment, and FIGS. 9 and 10 are graphs illustrating an effect according to a third exemplary embodiment.

As shown in FIGS. 7 and 8, in a display device according to a third exemplary embodiment, even after an input voltage Vin input to a power supply unit 180 is dropped to a level of a Under Voltage Lock Out (hereinafter, UVLO) or less due to power off, a discharge pulse that discharges a display panel 150 is generated. In FIG. 7, VGH means a gate high voltage, and SWS means a switching signal (a description related thereto is described with reference to the first exemplary embodiment).

An input voltage Vin input to the power supply unit 180 is dropped to a level of Under Voltage Lock Out (hereinafter, UVLO) or less due to power off. In this case, a UVLO circuit unit UVLO CKT outputs a lock signal (UVLO-Lock) changed from a logic low signal to a logic high signal. When a lock signal (UVLO-Lock) of logic high is output from the UVLO circuit unit UVLO CKT, the UVLO circuit unit UVLO CKT is in a state to which UVLO is applied. In this case, a voltage output from the power supply unit 180 is dropped with discharge.

When UVLO is applied to the power supply unit 180 due to power off, the power supply unit 180 changes a discharging pulse that discharges (discharging an output voltage) an output terminal thereof from a logic low signal to a logic high signal. That is, the power supply unit 180 activates a discharging pulse that discharges an output terminal thereof after entering to UVLO.

As shown in FIG. 8, the power supply unit 180 includes a discharge circuit unit 185. The discharge circuit unit 185 includes a discharge controller (DC) that controls discharge, a gate high voltage discharge unit (SWDA1) that discharges a gate high voltage VGH, and a gate low voltage discharge unit (SWDA2) that discharges a gate low voltage VGL. The gate low voltage VGL can be used to generate a gate signal (e.g., a low portion of the gate signal). The discharge circuit unit 185 performs a function of discharging a gate signal.

The gate high voltage VGH and the gate low voltage VGL correspond to a gate signal supplied to the display panel 150. The gate high voltage VGH is a voltage that turns on a transistor included in subpixels of the display panel 150, and the gate low voltage VGL is a voltage that turns off a transistor included in subpixels of the display panel 150.

A gate electrode of the SWDA1 is connected to an A1th discharging signal line of the DC, a first electrode of the SWDA1 is connected to an output terminal of a gate high voltage generator, and a second electrode of the SWDA1 is connected to a low potential voltage line.

When an A1th discharging signal DCA1 output from the DC is supplied, the SWDA1 discharges an output terminal of a gate high voltage generator. The SWDA1 performs a function of discharging residual electric charges (and residual electric charges of VGH existing at the display panel) of an output capacitor Ch located at an output terminal of a gate high voltage generator.

When an A2th discharging signal DCA2 output from the DC is supplied, the SWDA2 discharges an output terminal of a gate low voltage generator. The SWDA2 performs a function of discharging residual electric charges (and residual electric charges of VGL existing at a display panel) of an output capacitor C1 located at an output terminal of the gate low voltage generator.

As shown in FIG. 9, in a third exemplary embodiment, a switch on time (Discharging On waveform) of the SWDA1 may be varied as in D1'-D4'. In this case, when power is turned off, a discharge slope of a gate high voltage (VGH at Power Off) may be varied according to its switching on time. For example, discharge slopes of a gate high voltage in D1-D4 correspond to switch on times of D1'-D4', respectively. Same principle applies to a SWDA2.

As shown in FIG. 10, in a third exemplary embodiment, by varying a turn-on resistance (Discharging Switch Ron) value of the SWDA1, a discharge waveform of a gate high voltage may be varied as in D1"-D4".

As described above, the SWDA1 and the SWDA2 are formed with a transistor (or a switching element). The SWDA1 and the SWDA2 formed with a transistor may quickly discharge electric charges remaining at an output capacitor or a display panel existing at an output terminal of a power supply unit.

Implementing a resistor in place of a switch (SWDA1 or SWDA2) instead for discharging may be considered, but in this case current flows through the resistor regardless of whether the operation mode of the display device, thus power consumption is increased due to unnecessary power consumption through the resistor.

However, as in a third exemplary embodiment, when the SWDA1 and the SWDA2 are formed with a transistor instead of a resistor, discharge acceleration and a discharge speed can be adjusted and current leakage against a resistor can be prevented and thus consumption power of the device can be enhanced.

Fourth Exemplary Embodiment

Figure 11:
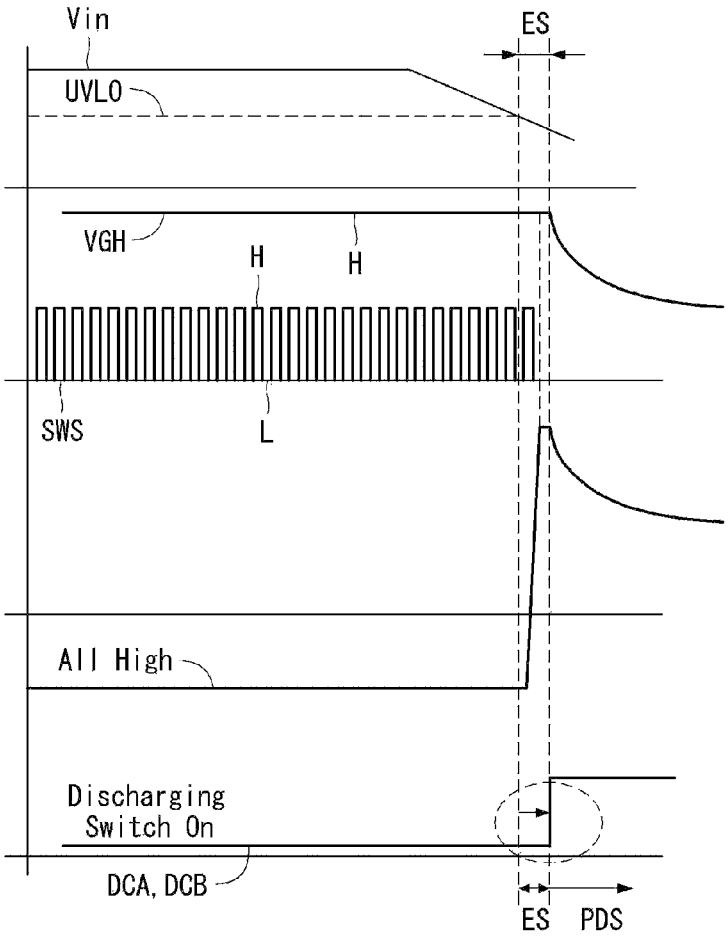
FIG. 11 is a waveform diagram illustrating a method of driving a device according to a fourth exemplary embodiment.
Figure 12:
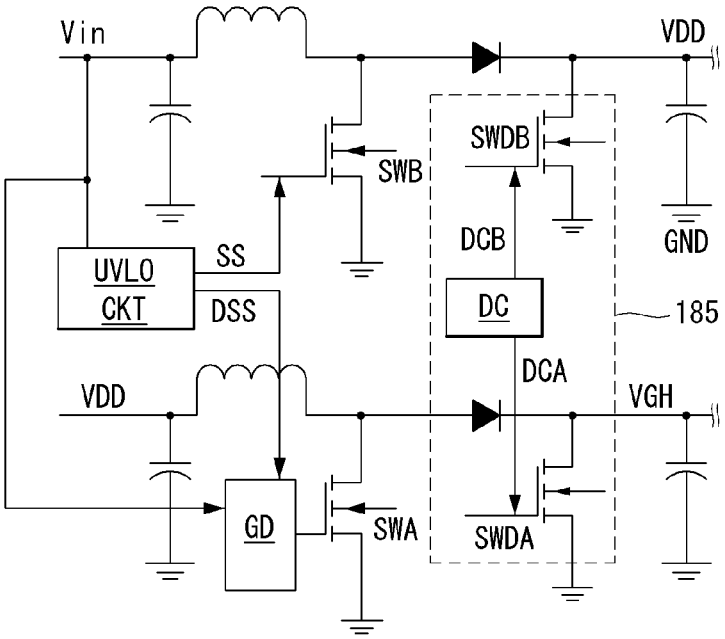
FIG. 12 is a diagram illustrating a circuit configuration of a portion of a power supply unit according to a fourth exemplary embodiment.
Figure 12:
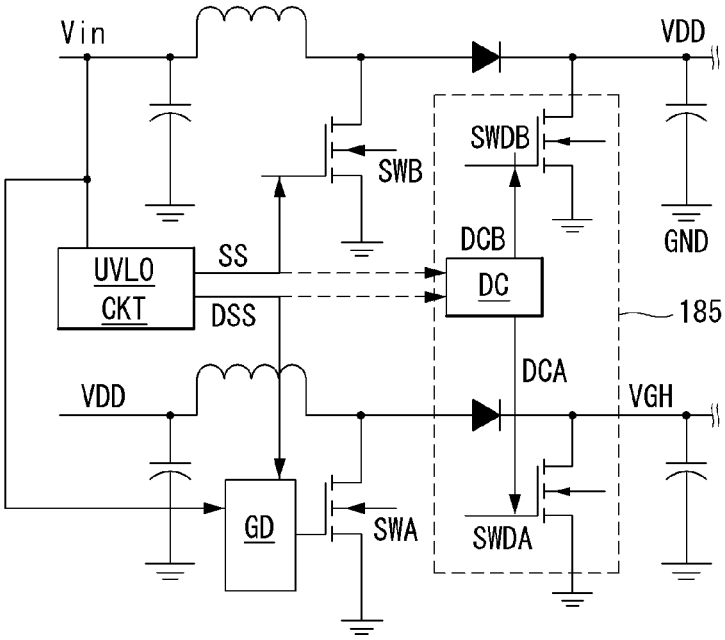
Figure 13:
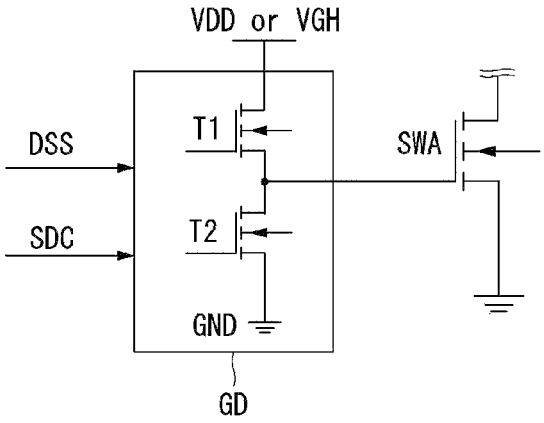
FIG. 13 is a diagram illustrating a circuit configuration of a gate voltage driver of FIG. 12.

FIG. 11 is a waveform diagram illustrating a method of driving a device according to a fourth exemplary embodiment, FIG. 12 is a diagram illustrating a circuit configuration of a portion of a power supply unit according to a fourth exemplary embodiment, and FIG. 13 is a diagram illustrating a circuit configuration of a gate voltage driver of FIG. 12.

As shown in FIGS. 11 and 12, in a display device according to a fourth exemplary embodiment, even after an input voltage Vin input to a power supply unit is dropped to a level of a Under Voltage Lock Out (hereinafter, UVLO) or less due to power off, a switching signal SWS for driving switching transistors SWA and SWB is not stopped but maintained (or delayed) for a predetermined time. In FIG. 11, All High means a gate all high signal.

When an input voltage Vin is dropped to UVLO or less due to power off, a switching signal SWS for driving switching transistors SWA and SWB is stopped. Therefore, a gate high voltage VGH with a voltage charged at the inside of a power supply unit in a state in which the power supply unit stops operation.

However, in a fourth exemplary embodiment, even if an input voltage Vin is dropped to UVLO or less due to power off, a switching signal SWS for driving a first switching transistor SWA is further maintained for a dummy switching period ES. Therefore, in a fourth exemplary embodiment, in a state in which a power supply unit maintains operation for a predetermined time, a voltage is generated and a gate high voltage VGH is formed based on the generated voltage.

Therefore, in a fourth exemplary embodiment, a gate all high signal (All High) is generated based on a high level of gate high voltage VGH that has occurred for a dummy switching period ES. Therefore, in a fourth exemplary embodiment, when power is turned off (after UVLO Lock), discharging of a panel can be stably performed.

Further, in a display device according to a fourth exemplary embodiment, a discharging period PDS that discharges residual electric charges of a display panel is activated after the dummy switching period ES.

Hereinafter, a description will be made based on a circuit configuration of FIGS. 11 and 12.

A power supply unit according to a fourth exemplary embodiment generates and outputs a first power source voltage VDD and a gate high voltage VGH based on an input voltage Vin. The power supply unit includes an UVLO circuit unit (UVLO CKT), a gate voltage driver (GD), first and second switching transistors SWA and SWB, and a discharge circuit unit 185. The power supply unit includes a first power source voltage generator that generates and outputs a first power source voltage VDD and a gate high voltage generator that generates and outputs a gate high voltage VGH.

The UVLO CKT monitors an input voltage Vin, and when the input voltage Vin is changed to a level lower than an operation voltage for operation of the power supply unit, the UVLO CKT performs a function of stopping a switching operation in order to protect a circuit.

For example, when an input voltage Vin is changed (dropped) to a level lower than an operation voltage due to power off of the device, the UVLO CKT immediately stops a switching operation of the second switching transistor SWB. However, even if an input voltage Vin is dropped to a level lower than an operation voltage due to power off, the UVLO CKT maintains a switching operation of the first switching transistor SWA for a predetermined time (dummy switching period).

The GD outputs a switching signal SWS that controls the first switching transistor SWA to boost a first power source voltage VDD transferred from a first power source voltage generator to convert the first power source voltage VDD to a gate high voltage VGH.

The GD outputs a switching signal SWS that may maintain a switching operation of the first switching transistor SWA for a predetermined time (dummy switching period) corresponding to a switching delay signal DSS transferred from the UVLO CKT. When the switching delay signal DSS is transferred from the UVLO CKT, the GD may convert an input voltage Vin and generate and output a gate high voltage VGH.

The first switching transistor SWA switches a first power source voltage VDD corresponding to a switching signal SWS output from the GD and generates and outputs a gate high voltage VGH. The first switching transistor SWA may generate and output a gate high voltage VGH for a predetermined time (dummy switching period) to correspond to a switching delay signal DSS transferred from the UVLO CKT.

The second switching transistor SWB switches an input voltage Vin corresponding to a signal output from an internal circuit and generates and outputs a first power source voltage VDD. The second switching transistor SWB stops a switching operation to correspond to a switching stop signal SS transferred from the UVLO CKT. When an input voltage Vin is changed to a level lower than an operation voltage for operation of the power supply unit, the switching stop signal SS is output from the UVLO CKT.

As shown in FIG. 12(*a*), the power supply unit includes a discharge circuit unit 185 that discharges residual electric charges of the display panel. The discharge circuit unit 185 generates and outputs discharging signals DCA and DCB for discharging residual electric charges (residual electric charges accumulated in the display panel by VGH) of the display panel.

The discharge circuit unit 185 includes a discharge controller (DC), a gate high voltage discharge unit (SWDA) that discharges a gate high voltage VGH output from a gate high voltage generator, and a first power source voltage discharge unit (SWDB) that discharges a first power source voltage VDD output from a first power source voltage generator.

A gate electrode of the SWDA is connected to a first discharging signal line of the DC, a first electrode of the SWDA is connected to an output terminal of the gate high voltage generator, and a second electrode of the SWDA is connected to a low potential voltage line. When a first discharging signal DCA corresponding to logic high is supplied from the DC, the SWDA discharges an output terminal of the gate high voltage generator.

A gate electrode of the SWDB is connected to a second discharging signal line of the DC, a first electrode of the SWDB is connected to an output terminal of the first power source voltage generator, and a second electrode of the SWDB is connected to a low potential voltage line. When a second discharging signal DCB corresponding to logic high is supplied from the DC, the SWDB discharges an output terminal of the first power source voltage generator.

The discharge circuit unit 185 of the power supply unit is used for enhancing power consumption of the display device. However, when the discharge circuit unit 185 independently operates, a period activated for discharging a display panel may conflict with a dummy switching period ES.

As shown in FIG. 12(*b*), the discharge circuit unit 185 generates and outputs first and second discharging signals DCA and DCB for discharging residual electric charges of the display panel, but generates the first and second discharging signals DCA and DCB after a switching delay signal DSS output from the UVLO CKT is terminated. That is, the first and second discharging signals DCA and DCB are activated at the discharging period PDS located after the dummy switching period ES.

For example, the first and second discharging signals DCA and DCB maintain a logic low signal for a display period that displays an image and a dummy switching period ES. However, after the dummy switching period ES is terminated, the discharge circuit unit 185 maintains a logic high signal for the discharging period PDS.

In a fourth exemplary embodiment, when generating a Discharging Switch On time using for discharging a display panel at the discharging period PDS after the dummy switching period ES is terminated, at power off, operation using a gate high voltage VGH can be performed in normal flow.

As shown in FIG. 13, the GD includes first and second transistors T1 and T2 that operate to correspond to a switching delay signal DSS and a switching duty control signal SDC output from the UVLO CKT.

The first and second transistors T1 and T2 are located between a voltage line to which a first power source voltage VDD or a gate high voltage VGH is supplied and a low potential voltage line to which a low potential voltage GND is supplied. A gate electrode of the first transistor T1 is connected to a switching delay signal line to which a switching delay signal DSS is supplied, a first electrode of the first transistor T1 is connected to a voltage line to which the first power source voltage VDD or the gate high voltage VGH is supplied, and a second electrode of the first transistor T1 is connected to a gate electrode of the first switching transistor SWA. A gate electrode of the second transistor T2 is connected to a switching duty control signal line to which a switching duty control signal SDC is supplied, a first electrode of the second transistor T2 is connected to a low potential voltage line, and a second electrode of the second transistor T2 is connected to a gate electrode of the first switching transistor SWA.

The first and second transistors T1 and T2 control the first switching transistor SWA according to a switching delay signal DSS and a switching duty control signal SDC. A switching signal that controls a switching operation of the first switching transistor SWA varies a pulse width or a duty according to a turn on/turn off operation of the first and second transistors T1 and T2. However, this is an illustration and the GD may be formed as described with reference to FIG. 6.

As described above, the display device in various embodiments described herein can prevent (can improve reliability of a device) a discharging operation of a panel is recognized by an eye of a person or that image quality deterioration (screen shake) occurs by discharging an output terminal of a power supply unit and a display panel with a stable voltage when power of a device is turned off. Further, the display device in various embodiments described herein can enhance power consumption by eschewing an unnecessary power loss during a normal operation by implementing a discharge circuit that can actively operate rather than a resistor.

What is claimed is:

1. A power supply circuit comprising:

a voltage level detector configured to detect whether an input voltage falls below a predetermined threshold voltage;

a gate voltage driver configured to:

generate a switching pulse signal, responsive to the voltage level detector detecting the input voltage being above the predetermined threshold voltage, and generate the switching pulse signal for a predetermined time period, responsive to the voltage level detector detecting the input voltage dropping below the predetermined threshold voltage from above the predetermined threshold voltage; and a voltage converting circuit configured to generate a gate voltage at an output terminal of the voltage converting circuit based on the input voltage and the switching pulse signal to supply a gate signal to pixels of a panel, the gate voltage at a first level generated responsive to the switching pulse signal, the gate voltage at the first level higher than the gate voltage at a second level absent the switching pulse signal, the gate voltage applied to pixels through gate lines of a display panel.

2. The power supply circuit of claim 1, wherein the voltage converting circuit comprises:

a power source voltage generator configured to receive the input voltage and generate a power supply voltage responsive to the voltage level detector detecting the input voltage being above the predetermined threshold voltage; and a gate voltage generator configured to generate the gate voltage based on the power supply voltage and the switching pulse signal.

3. The power supply circuit of claim 2, wherein the power source voltage generator is further configured to:

generate the power supply voltage at a third voltage level responsive to the voltage level detector detecting the input voltage being above the predetermined threshold voltage, and generate the power supply voltage at a fourth voltage level responsive to the voltage level detector detecting the input voltage being below the predetermined threshold voltage, the third voltage level higher than the fourth voltage level.

4. The power supply circuit of claim 2, wherein the voltage level detector is further configured to generate another switching pulse signal responsive to detecting the input voltage being above the predetermined threshold voltage, and to not generate the other switching pulse signal responsive to detecting the input voltage being below the predetermined threshold voltage, and wherein the power source voltage generator is configured to generate the power supply voltage at a third voltage level responsive to the other switching pulse signal, and generate the power supply voltage at a fourth voltage level responsive to the other switching pulse signal without the switching pulse signal, the third voltage level being higher than the fourth voltage level.

5. The power supply circuit of claim 2, further comprising:

a gate voltage compensation circuit configured to supply one of the power supply voltage and the gate voltage to the gate voltage driver to generate the gate voltage, responsive to the input voltage dropping below a reference voltage level.

6. The power supply circuit of claim 2, further comprising a discharging circuit coupled to the output terminal of the voltage converting circuit, the discharging circuit configured to discharge charges stored at the output terminal, after the predetermined time period.

7. The power supply circuit of claim 6, wherein the discharging circuit is a transistor, a first electrode of the transistor coupled to the output terminal, a second electrode of the transistor coupled to a ground voltage, and a third electrode of the transistor coupled to a discharge controller.

* * * * *